US006634261B1

(12) United States Patent
Griffin

(10) Patent No.: US 6,634,261 B1
(45) Date of Patent: Oct. 21, 2003

(54) SOCKET MAGAZINE

(76) Inventor: Wendell Griffin, 13783 Hwy. 431 North, Central City, KY (US) 42330

( * ) Notice: Subject to any disclaimer, the term of this patent is extended or adjusted under 35 U.S.C. 154(b) by 0 days.

(21) Appl. No.: 09/939,367

(22) Filed: Aug. 24, 2001

Related U.S. Application Data

(60) Provisional application No. 60/245,497, filed on Nov. 3, 2000.

(51) Int. Cl.[7] ..... B25B 13/48
(52) U.S. Cl. ..... 81/124.1; 81/125
(58) Field of Search ..... 81/121.1, 124.1, 81/125, 186

(56) References Cited

U.S. PATENT DOCUMENTS

| | | | | | |
|---|---|---|---|---|---|
| 847,596 | A | | 3/1907 | McMurtry | |
| 848,194 | A | | 3/1907 | McMurtry | |
| 851,181 | A | | 4/1907 | McMurtry | |
| 868,436 | A | | 10/1907 | Hermand | |
| 1,474,236 | A | | 11/1923 | Byrne | |
| 1,503,692 | A | | 8/1924 | McCarthy | |
| 1,543,175 | A | | 6/1925 | McCarthy | |
| 1,607,421 | A | | 11/1926 | Work | |
| 2,277,945 | A | | 3/1942 | Ashleman | |
| 2,493,398 | A | | 1/1950 | Fricke | |
| 2,720,804 | A | * | 10/1955 | Brown | 81/125 |
| 2,833,548 | A | * | 5/1958 | Clark | 81/125 |
| 2,868,053 | A | | 1/1959 | Jorgensen et al. | |
| 2,895,360 | A | | 7/1959 | Madsen | |
| 2,896,489 | A | | 7/1959 | Madsen | |
| 2,930,267 | A | | 3/1960 | Apicelli | |
| 2,993,397 | A | | 7/1961 | Albertson et al. | |
| 3,005,367 | A | | 10/1961 | Vose | |
| 3,063,316 | A | | 11/1962 | Salierno | |
| 3,253,626 | A | * | 5/1966 | Stillwagon et al. | 81/125 |
| 4,058,032 | A | * | 11/1977 | Jacks | 81/125 |
| 5,388,486 | A | * | 2/1995 | Ruzicka et al. | 81/121.1 |
| 5,481,948 | A | * | 1/1996 | Zerkovitz | 81/121.1 |
| 5,640,889 | A | * | 6/1997 | Anderson | 81/125 |

* cited by examiner

*Primary Examiner*—James G. Smith
(74) *Attorney, Agent, or Firm*—Camoriano and Associates; Theresa Fritz Camoriano

(57) ABSTRACT

A socket magazine is made of a tubular body with a drive end and an open end. An O-ring lies in an annular groove in the tubular body and retains nuts in the tubular body while permitting them to squeeze past the O-ring for insertion into the magazine and removal from the magazine. A biasing spring biases the nuts toward the O-ring.

12 Claims, 2 Drawing Sheets

SOCKET MAGAZINE

BACKGROUND OF THE INVENTION

This application claims priority from U.S. provisional patent application Ser. No. 60/245,497, filed on Nov. 3, 2000. The present invention relates to a socket magazine for removing, storing, and installing several nuts at a time.

Various socket magazines are known. They use a variety of mechanisms to retain the nuts in the magazine and to permit the nuts to be inserted into and released from the magazine. Some of these mechanisms may be expensive to manufacture or difficult to use or maintain.

SUMMARY OF THE INVENTION

The present invention provides a socket magazine that uses a very simple retaining mechanism for retaining the nuts in the magazine. In a preferred embodiment of the present invention, a tubular body, with an internal profile having flat portions that match the shape of the nuts, is used to store the nuts. An axially oriented spring inside the tubular body biases a washer toward an open end of the tubular body to push the nuts toward the open end. An O-ring lies recessed into an internal circumferential notch on the tubular body, close to the open end of the tubular body. The inside circumference of the O-ring is just large enough to permit the nuts to squeeze past the O-ring by pressing the O-ring against the circumferential notch when the nuts are being installed or removed, but the O-ring retains the nuts under other circumstances, so they do not accidentally fall out of the magazine.

To use the magazine, the open end is inserted over a first nut to be removed, and some type of drive, such as a socket wrench, is attached to the other end of the magazine. The nut engages the inner surface of the magazine. The drive is used to rotate the magazine about its longitudinal axis, unthreading the nut from its corresponding stud until the nut is fully removed from the stud. The magazine is then relocated and is inserted over a second nut. The second nut pushes the first nut past the O-ring and into the storage magazine, where it pushes against the washer. The biasing spring pushes the washer against the first nut, so that this first nut is caught between the washer and the O-ring. The second nut is removed in the same manner as the first. This procedure is repeated for as many nuts as desired, or until the magazine is full, and all the nuts which are removed are stored in a neatly stacked fashion, inside the magazine.

When it is time to install the nuts on their respective bolts or studs, the loaded magazine is placed over a first stud, pressing the magazine toward the stud until the threads of the stud engage the threads of the outermost nut in the magazine. The driver is used to rotate the magazine about its longitudinal axis so as to tighten the nut onto the stud. As the nut is tightened onto its stud, it is drawn out of the magazine, squeezing past the retaining O-ring. The remaining nuts remain in the magazine, held back by the O-ring, until another stud engages the next outermost nut. If the stud is long enough that it begins to engage a second nut after it has engaged a first nut, it may be desirable to use the magazine first to begin threading each nut onto its respective stud, and, once the magazine is empty, to go back and tighten each nut onto its stud, or to use a different socket to finish tightening the nuts onto their studs. Once the threads of a nut begin to engage the threads of a stud, the magazine may be pulled away from the stud, and the nut will pull out of the magazine past the retaining O-ring.

DESCRIPTION OF THE PREFERRED EMBODIMENT

Figure 1:
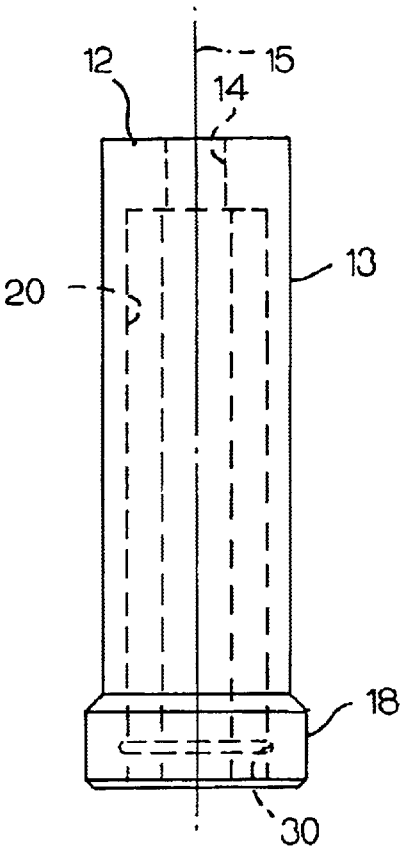
FIG. 1 is a side view of a socket magazine made in accordance with the present invention.

FIGS. 1–7 show a preferred embodiment of a socket magazine 10, in accordance with the present invention. The socket magazine 10 is preferably sized to receive lug nuts 22, although it could be made in other sizes as well. This preferred embodiment of a socket magazine 10 includes a tubular body wall 13 that is substantially cylindrical in shape. The first end 12 of the magazine 10 is substantially closed, except for a square, central opening 14, which is sized to receive a standard drive tool 16, such as a ratchet or an air wrench. This central opening 14 has ball detents 32, which are used to retain the magazine 10 on the drive tool 16, as is well known in the art. The second end 18 of the magazine 10 is open. The interior surface of the magazine 10 has a non-cylindrical shape and is sized and shaped to receive the nuts 22, which, in this case, are hexagonal nuts. The interior surface of the magazine 10 has a scalloped shape and is shown best in FIGS. 2 and 2A. The interior surface includes flat drive surface portions 20, which are angularly spaced and equidistant from the axis 15 of rotation of the magazine 10. The flat portions 20 are located so as to contact the central portions of the flat faces of a hexagonal nut 22 that is received inside the magazine 10. Between the flat portions 20 are larger diameter portions in the shape of arcuate recesses 11. The arcuate recesses 11 are located in the area of the angular points of the nut, where the flat faces of the nut intersect.

Figure 2A:
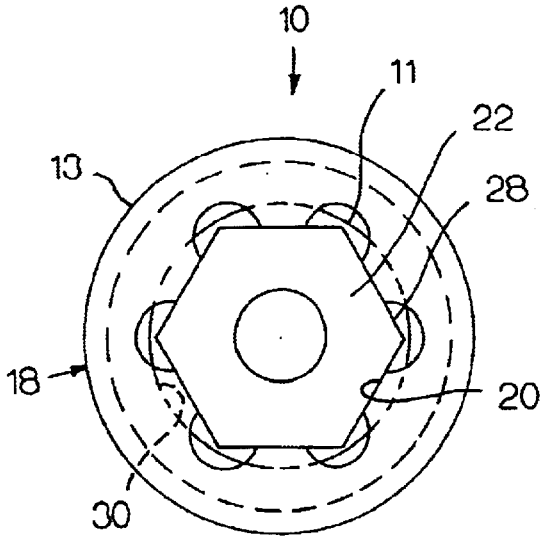
FIG. 2A is an end view of the socket magazine of FIG. 1 taken from the other end, and with a nut inside the magazine.
Figure 3:
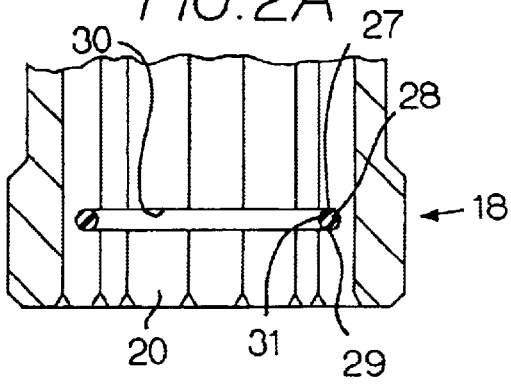
FIG. 3 is a broken away sectional view taken along line 3—3 of FIG. 2.
Figure 2:
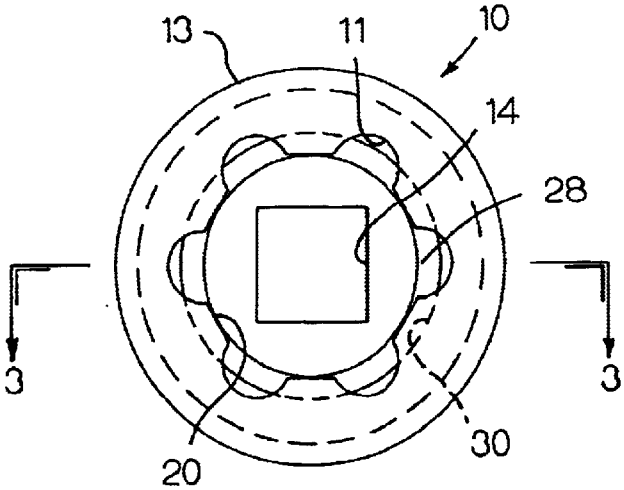
FIG. 2 is an end view of the socket magazine of FIG. 1.
Figure 4:
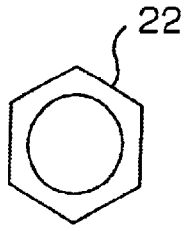
FIG. 4 is a plan view of a typical nut received in the magazine of FIG. 1.

In the interior of the socket magazine 10, adjacent to the first end 12, is a spring 24, which biases a washer 26 toward the open end 18 of the magazine 10. As shown in FIGS. 1 and 2, adjacent to the open end 18 is an annular groove 30 in the scalloped surface which retains an O-ring 28. The arcuate recesses 11 extend farther from the axis of rotation 15 of the magazine 10 than does the annular groove 30, providing an area into which the O-ring 28 can deform to allow a nut to pass. The O-ring 28 forms a passageway through which nuts must pass in order to enter into the interior of the socket magazine 10. As shown in FIG. 3, the O-ring 28 in this embodiment has a circular cross-section, so the passageway that it forms has a first large inside diameter 27 facing the first end 12 of the magazine, a second large inside diameter 29 facing the open second end 18 of the magazine 10, and gradually tapers inwardly from its larger diameter first and second ends 27, 29 to an intermediate minimum inside diameter portion 31. This two-way gradual taper, from the inside 27 to the smaller diameter intermediate portion 31 and from the outside 29 to the smaller diameter intermediate portion 31, helps ease nuts smoothly into and out of the socket magazine 10, while retaining the nuts in the magazine when they are not intentionally being moved into or out of the magazine. The O-ring 28 is sized so that the inside diameter of the smaller diameter intermediate portion 31 of the passageway is substantially the same as the distance between two opposed flats 20, so the O-ring just interferes with the largest diameter portions of the nut 22 (namely, the vertex portions, which are located in the area of the arcuate recesses 11). The nuts 22 can deform the O-ring 28 into the arcuate recesses 11 in order to squeeze past the O-ring 28 when they are pushed or pulled, but otherwise the O-ring 28 retains the nuts 22 in the magazine 10.

The O-ring 28 is made of an elastomeric material, which permits it to deform into the arcuate recesses 11. As shown in FIG. 3, the O-ring has a substantially circular cross-section. The O-ring is independent of the tubular body, being neither adhered to nor cast in place in the tubular body, and being held in position only by its own elasticity, so it can readily be removed and replaced.

Figure 5:
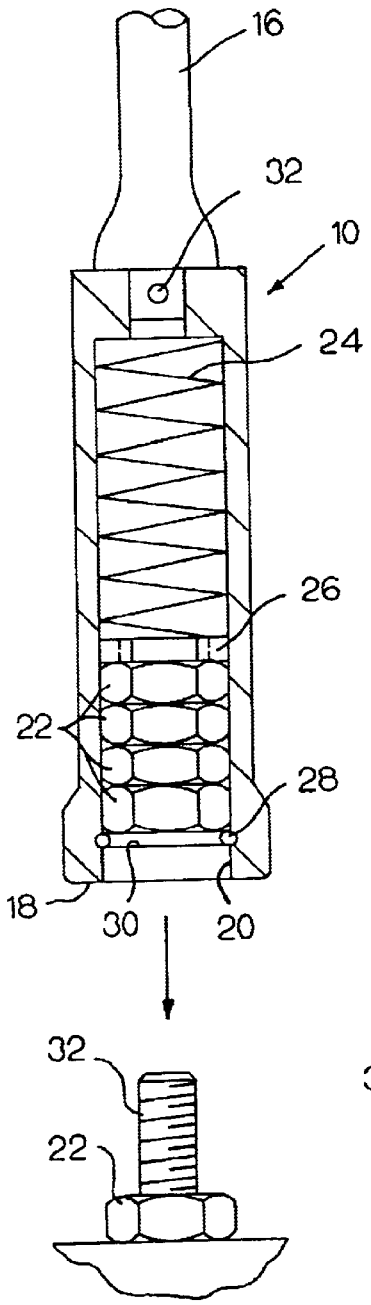
FIG. 5 is a side view, partially in section, of the socket magazine of the present invention with four nuts already stored in the magazine.
Figure 6:
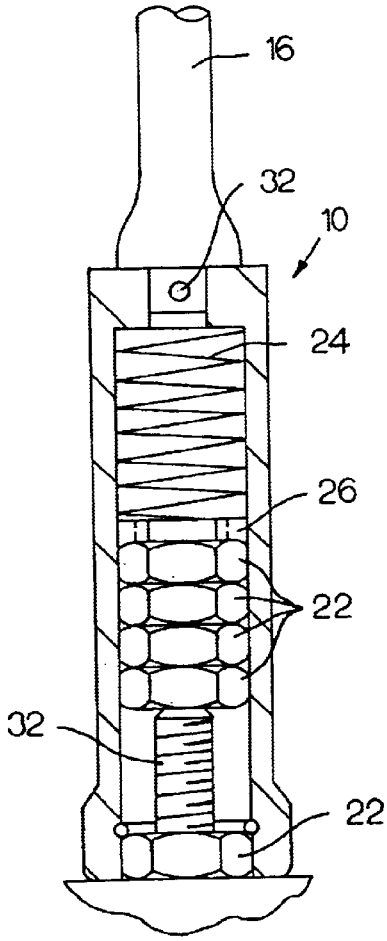
FIG. 6 is the same view as in FIG. 5 except that the socket magazine has been placed over the nut to be removed, pushing the nuts already in the magazine further into the magazine; and, FIG. 7 is the same view as in FIGS. 5 and 6 except that the nut which was on the stud has now been removed and is stored in the magazine together with the other nuts.
Figure 7:
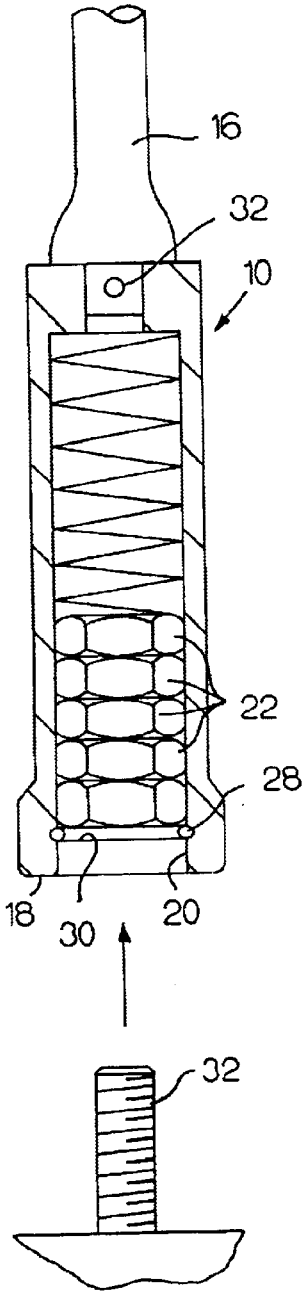

As shown in FIGS. 5–7, a plurality of nuts 22 can be inserted into the open end 18 of the magazine 10. The nuts 22 are biased toward the second end 18 by the spring 24 and the washer 26, but they are prevented from failing out of the magazine 10 by the retaining O-ring 28. Once the desired number of nuts 22 is inserted into the magazine 10, the nuts 22 may be rapidly threaded onto their respective threaded studs 32 by the drive tool 16, without having to stop to insert new nuts 22 each time. Similarly, a plurality of nuts 22 may be removed from respective threaded studs 32 without having to stop to remove each nut 22 from the tool 10.

While the preceding description describes a scalloped interior surface with arcuate recesses, it is understood that the recesses need not be arcuate, but they should preferably have a larger diameter than the normal outside diameter of the O-ring.

These magazines greatly speed up the installation and removal of a number of nuts, such as when installing or removing lug nuts from an automobile wheel. It will be obvious to those skilled in the art that modifications may be made to the embodiments described above without departing from the scope of the present invention.

What is claimed is:

1. A socket magazine, comprising:

a tubular body defining an outside surface, an inside surface, a first end, a substantially open second end, and an annular groove in said inside surface proximate said second end;

a continuous elastomeric ring lying in said groove, said continuous elastomeric ring defining a passageway into said tubular body;

wherein said passageway defined by said elastomeric ring has a first large inside diameter end facing said first end of said tubular body and a second large inside diameter end facing said second end of said tubular body, and said passageway gradually tapers inwardly from said first and second large inside diameter ends toward an intermediate smaller inside diameter area;

a socket in said first end for receiving a drive tool; and a biasing spring inside said tubular body, with one end of said spring pushing against said first end of said tubular body.

2. A socket magazine, comprising:

a tubular body defining an outside surface, an inside surface, a first end, a substantially open second end, and an annular groove in said inside surface proximate said second end, said annular groove having a fixed length and diameter;

an elastomeric ring lying in said groove;

a socket in said first end for receiving a drive tool; and a biasing spring inside said tubular body, with one end of said spring pushing against said first end of said tubular body, wherein said elastomeric ring is an O-ring, forming a passageway into said socket, said passageway having a first large inside diameter end facing said first end, a second large inside diameter end facing said second end, and gradually tapering toward a smaller inside diameter intermediate area.

3. A socket magazine as recited in claim 1, wherein said magazine defines an axis of rotation, and wherein said inside surface of said tubular body has a scalloped shape, including a plurality of angularly-spaced, elongated, substantially flat drive surfaces equidistant from the axis of rotation of said socket magazine, and a plurality of larger diameter surfaces between said substantially flat drive surfaces.

4. A socket magazine as recited in claim 3, wherein said elastomeric ring has enough flexibility and enough room within the inside surface of said magazine to conform substantially to the shape of a hexagonal nut having flat faces sized to fit snugly within the flat drive surfaces of the magazine.

5. A socket magazine as recited in claim 1, and further comprising a washer inside said tubular body between the biasing spring and the second end of the tubular body, for biasing nuts toward the second end of said tubular body.

6. A socket magazine as recited in claim 1, and further comprising a drive tool received in the socket at the first end of said tubular body.

7. A socket magazine, comprising:

a tubular body defining an outside surface, an inside surface, a first end, and a substantially open second end; said first end defining a socket in its outer surface for receiving a drive tool; said inside surface defining a plurality of elongated, opposed, flat drive surfaces located so as to contact the flat faces of a hexagonal nut; and said inside surface defining an annular groove proximate said second end;

an O-ring received in said groove, said O-ring being sized to retain a hexagonal nut sized slightly smaller than the size defined by said opposed flat drive surfaces, and wherein said O-ring can be compressed into its annular groove to permit such a hexagonal nut to pass by;

said O-ring forming a passageway into said tubular body, said passageway having large diameter first and second ends facing said first and second ends of said tubular body, respectively, and gradually tapering toward a smaller diameter intermediate portion;

a biasing spring inside said tubular body adjacent to said first end; and a washer adjacent to said biasing spring, said washer being free to slide along said inside surface of said tube.

8. A socket magazine as recited in claim 2, wherein said magazine defines an axis of rotation, and wherein said inside surface of said tubular body has a scalloped shape, including a plurality of angularly-spaced, elongated, substantially flat drive surfaces equidistant from the axis of rotation, and a plurality of larger diameter scallops between said substantially flat drive surfaces; wherein said O-ring is sized so that, in its normal position, it will retain a nut of the size that can be driven by the flat drive surfaces, and wherein said O-ring can be deformed into said larger diameter scallops in order to allow such a nut to pass by.

9. A socket magazine as recited in claim 1, wherein said tubular body is a unitary piece, and said groove has a fixed length and diameter.

10. A socket magazine as recited in claim 2, wherein said O-ring has a substantially circular cross-section, said groove has a complementary arcuate shape which receives and retains said O-ring, and said O-ring is independent of said tubular body, removably resides in said groove, and is held in position by its own elasticity.

11. A socket magazine as recited in claim 7, wherein said O-ring has a substantially circular cross-section.

12. A socket magazine as recited in claim 1, wherein said continuous elastomeric ring has a substantially circular cross-section.

* * * * *

UNITED STATES PATENT AND TRADEMARK OFFICE

CERTIFICATE OF CORRECTION

PATENT NO. : 6,634,261 B1 
DATED : October 21, 2003
INVENTOR(S) : Wendell Griffin It is certified that error appears in the above-identified patent and that said Letters Patent is hereby corrected as shown below:

Column 3,
Line 24, delete “failing” and insert therefor -- falling --.

Signed and Sealed this

Second Day of December, 2003

JAMES E. ROGAN
*Director of the United States Patent and Trademark Office*